United States Patent [19]

Morin et al.

[11] 4,407,223

[45] Oct. 4, 1983

[54] CONTOUR CEMENTING MACHINE

[75] Inventors: Robert W. Morin, Salem; Jeffrey M. Lewis, Lynn; Richard Bobrycki, Saugus, all of Mass.

[73] Assignee: Boston Machine Works Company, Lynn, Mass.

[21] Appl. No.: 338,642

[22] Filed: Jan. 11, 1982

[51] Int. Cl.[3] ..... B05C 1/02

[52] U.S. Cl. ..... 118/212; 118/238; 118/243; 118/263

[58] Field of Search ..... 118/243, 238, 212, 263; 101/41

[56] References Cited

U.S. PATENT DOCUMENTS

| | | | |
|---|---|---|---|
| 834,181 | 10/1906 | Bell | 101/41 |
| 1,960,341 | 5/1934 | Keith | 118/212 |
| 2,035,971 | 3/1936 | Magnusson | 118/241 X |
| 2,493,953 | 1/1950 | Emerson | 101/41 |
| 2,781,278 | 2/1957 | Harmon | 118/202 X |
| 3,030,915 | 4/1962 | Shannon | 118/202 |
| 3,108,537 | 10/1963 | Way et al. | 118/243 X |
| 3,255,726 | 6/1966 | Stephens et al. | 118/243 X |
| 4,363,287 | 12/1982 | Ewing et al. | 118/50 |

OTHER PUBLICATIONS

*Textbook of Polymer Science,* Author: Fred W. Billmeyer, Jr., ©1962 by John Wiley & Sons Inc., pp. 363–371.

Fly Sheet of Boston Machine Works Company entitled Boston Bottom Cementing Machine, Model 20PR.

Fly Sheet of Boston Machine Works Company entitled Boston Double Marginal Latex Cementing Machine--Model 13 PRA.

Brochure of Boston Machine Works Company entitled Boston Double Marginal Latex Cementer, Model 231.

*Primary Examiner*—John P. McIntosh
*Assistant Examiner*—Mary Beth Calligaris
*Attorney, Agent, or Firm*—Morse, Altman & Dacey

[57] ABSTRACT

A contour cementing machine for applying latex cement in complex shapes to flat work pieces, such as shoe parts, belts, luggage parts, etc. The contour cementing machine includes a housing mounting die means, a removable tray for containing cement, means for maintaining the cement at a predetermined level, and means for actuating the die means. Preferably, the actuating means is pneumatic. Preferably, the die means is characterized by ease of convertibility of differing sizes, shapes and styles of work pieces.

6 Claims, 10 Drawing Figures

CONTOUR CEMENTING MACHINE

BACKGROUND OF THE INVENTION

1. Field of the Invention

The present invention relates generally to cementing machines and, more particularly, to a contour cementing machine for applying latex cement in complex shapes to flat work pieces, such as shoe parts, belts, luggage parts and the like.

2. The Prior Art

Shoes, luggage and the like are assembled of flat pieces die cut from suitable sheet material, be it leather, cloths or plastic. Many of these flat pieces come in complex shapes and contours. Before their assembly, these contoured flat pieces must be cemented in certain areas preparatory to sticking along those areas. The application of cement to these areas must be even and precisely located. Originally, cement had been applied to such "flatties" by hand with the aid of a brush. Needless to say, hand application of cement was messy, tiresome, time consuming—hence expense, and yet characterized by unevenness and lack of uniformity of application regards the amount, thickness and width of cement applied to the work. Roller-type machines have been developed to fill the need. Such roller-type machines have serious limitations, however. First, they cannot handle complex shapes and contours. Second, they cannot deposit cement inwardly of the workpiece but only at the edges thereof. Roller-type dispensers operated by hand overcome these two deficiencies but still suffer from the others above noted, to wit, being messy, tiresome, time consuming and still wanting in uniformity of application. The mask and spray system, on the other hand, is most wasteful in its use of cement.

There is thus a need for a machine for applying latex cement in complex shapes to flat work pieces.

SUMMARY OF THE INVENTION

It is a principal object of the present invention to overcome the above disadvantages by providing a contour cementing machine capable of applying latex cement in complex shapes and anywhere to flat work pieces evenly, accurately, uniformly and yet inexpensively.

More specifically, it is an object of the present invention to provide a contour cementing machine comprising a housing having a cover, a die structure mounted in the housing and including a workplate supporting flat work pieces and designed to move in and out of the housing and a die plate carrying a plurality of die members, a tray removably mounted in the housing in operative association with the die structure, means for maintaining a predetermined level of cement in the tray, and means for actuating the die structure. Preferably, the actuating means is pneumatic. Preferably, the die structure is characterized by ease of convertibility to differing sizes, shapes and styles of work pieces.

Other and further objects of the present invention will in part be obvious and will in part appear hereinafter.

The invention accordingly comprises the contour cementing machine of the present disclosure, its components, parts and their interrelationships, the scope of which will be indicated in the appended claims.

BRIEF DESCRIPTION OF THE DRAWINGS

For a further understanding of the nature and objects of the present invention, reference is to be made to the following detailed description, which is to be taken in connection with the accompanying drawings, wherein.

DETAILED DESCRIPTION OF THE PREFERRED EMBODIMENT

Figure 1:
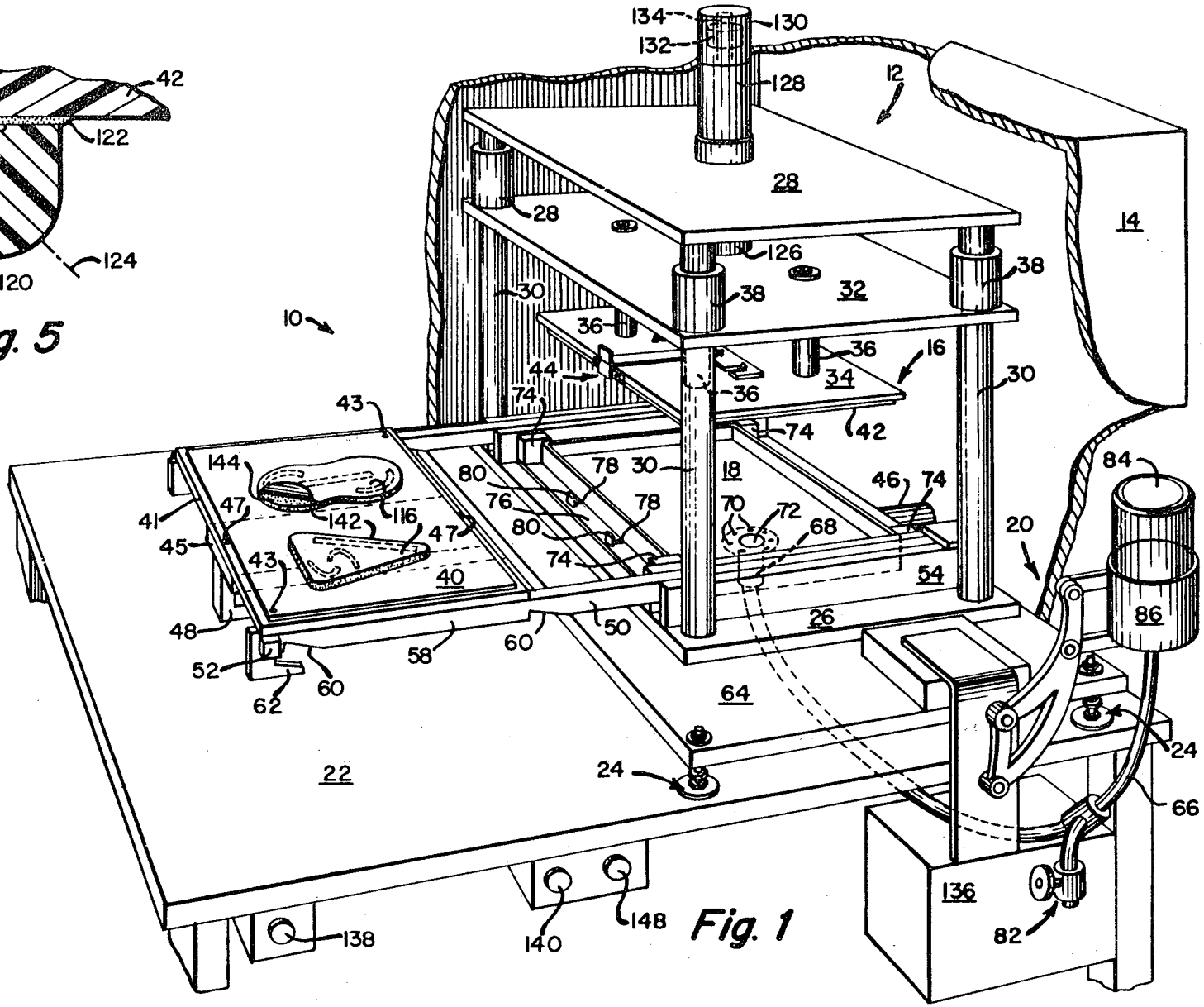
FIG. 1 is a perspective view of a contour cementing machine constructed in accordance with the present invention.

Generally, the illustrated embodiment of a contour cementing machine 10, designed for applying latex cement in complex shapes to flat work pieces, comprises a housing 12 provided with a protective cover 14, a die structure 16 mounted in the housing 12, a cement tray 18 disposed in the housing 12 in operative association with the die structure 16, and means 20 for maintaining a predetermined level of cement in the tray 18. Preferably, the contour cementing machine 10 is pneumatically actuated and is easily hooked up to a source (not shown) of fluid, such as air, under pressure. Preferably, the die structure 16 is characterized by ease of convertibility to widely differing sizes, shapes and styles of flat work pieces, as will be more fully described below. Preferably, the cement tray 18 is easily removable, without tools, for purposes of cleaning, as will also be more fully described below. Further preferably, the contour cementing machine 10 is designed so that it can be left inoperative, with the air pressure remaining on, for hours without any need to drain off the latex cement from the tray 18. Also preferably, the width of cement applied to a flat work piece can be conveniently varied, within limits, by a simple adjustment, also as will be more fully described below. Further preferably, the contour cementing machine 10 is designed with built-in safety features to protect the operator, also as will be more fully described below. Despite these several advantageous features, the contour cementing machine 10 is relatively simple to manufacture and to operate.

As shown in FIG. 1, the contour cementing machine 10 is a bench-type machine that is firmly secured to a table top 22 by a plurality of bolts and nuts 24. These bolts and nuts 24 are adjustable so as to allow the precise leveling of the machine 10 on the table top 22. The housing 12 comprises a base plate 26, a top plate 28, a plurality of posts 30 securing the top plate 28 in spaced apart relation to the base plate 26, an actuating plate 32 carried for vertical displacement by the plurality of posts 30, and a carrier plate 34 secured to the actuating plate 32 by a number of bars 36. Preferably, to facilitate the vertical displacement of the actuating plate 32 about the posts 30, a plurality of self-aligning bearing blocks 38 are provided. These bearing blocks 38 are secured to the actuating plate 32 and are designed to ride about the outer periphery of the posts 30. The self-aligning feature of these blocks 38 assures that the actuating plate 32 and the thereto attached carrier plate 34 remain, at all times, in parallel spaced relation to the base and top plates 26 and 28, even when displaced at various levels therebetween. The maintenance of this parallelism is important for the proper operation of the contour cementing machine 10, as will be more fully apparent from below.

The primary function of the housing 12 is to house the die structure 16 and the removable tray 18 in operative association. The die structure 16 comprises a workplate 40 removably mounted on a slide tray 41 by pins 43, a die plate 42, a quick connect and disconnect mechanism 44 for the die plate 42, and means 46 for effecting movement of the workplate 40 in and out of the housing 12. The means 46 for effecting this horizontal movement of the workplate 40 includes a double-acting piston-cylinder 48 combination, a pair of elongated supporting members 50 operatively connected to the piston of the piston-cylinder 48 via the slide tray 41 and a bar member 45 secured longitudinally to the underside of the slide tray 41 by a number of screws 47, and a pair of channels 54 for slidably accommodating therein the pair of supporting members 50. Preferably, each of the channels 54 is designed to accommodate therein a plurality of rollers 56, observe FIGS. 7–10. These rollers 56 facilitate the transverse motion of the supporting members 50, whose underside 58 ride on the rollers 56. Preferably, a pair of stops 52 are provided on the members 50. The stops 52 abut against the ends of the channels 54 and thus arrest the transverse motion of the members 50. The undersides 58 of each of the pair of supporting members 50 are provided with a pair of spaced inclined indents 60 and an end hook 62. The significance of these inclined indents 60 and of the end hooks 62 will become apparent from below when describing the contour cementing machine's 10 operation.

In the space between the pair of channels 54 is disposed the cement tray 18, resting on the base plate 26, which is carried by a bottom plate 64. Each of the plates 26 and 64 is provided with suitable openings (not shown) to accommodate a cement hose 66. The tray 18 is provided on its underside with an appropriate fitting 68 to which the end of the hose 66 can be easily and removably secured. The fitting 68 is attached to the tray 18 by a member of screws 70 about a hole 72 formed in the bottom of the tray 18. The tray 18, which preferably is formed of polyethylene, as by injection molding, is held in place by four L-shaped members 74. Two of these L-shaped members 74, located at the rear of the machine 10 adjacent the cylinder 46, preferably are stationarily secured to the base plate 26. The front two L-shaped members 74 preferably are secured to a bar 76 which is pivotally mounted onto the base plate 26. The bar 76 is formed with a couple of slots 78 designed to accommodate a pair of twistable fastening members 80. With the hose 66 disconnected and the bar 76 raised, after the appropriate 90° turn of the members 80, the front two L-shaped members 74 become disengaged from the tray 18, which can now be conveniently pulled out toward the front of the machine 10, and that without any tools being utilized at all. Of course, any cement from the tray 18 and the hose 66 is first being removed via a valved connection 82. In the alternative, the pivotable bar 76 may be dispensed with, the front L-shaped members 74 may be mounted stationarily, and the rear two L-shaped members 74 may be mounted pivotally to the base plate 26. In this case, the tray 18 can be removed toward the rear of the machine 10, again without using any tools.

Latex cement preferably is gravity-fed from a container 84 introduced upside down into a receptacle 86, to which the other end of the hose 66 is connected. The level of latex cement in the tray 18 first is determined by the height selected, and then secured, for the receptable 86 above the bottom plate 64 by the means 20. With this height for the receptacle 86 set, it is assured that this predetermined level of latex cement in the tray 18 is maintained during continuous cementing operation by the contour cementing machine 10. Of course, the operator will have to replace the container 84 when empty with a full container 84. The selection and the maintenance of the predetermined level of latex cement without the tray 10 is important for the proper functioning of the contour cementing machine 10, as will be more fully apparent from the discussion below.

Figure 2:
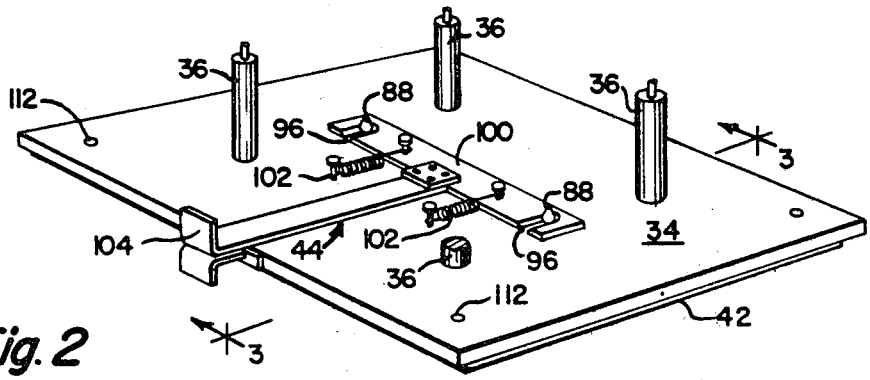
FIG. 2 is a perspective view of a part of the contour cementing machine of FIG. 1.
Figure 3:
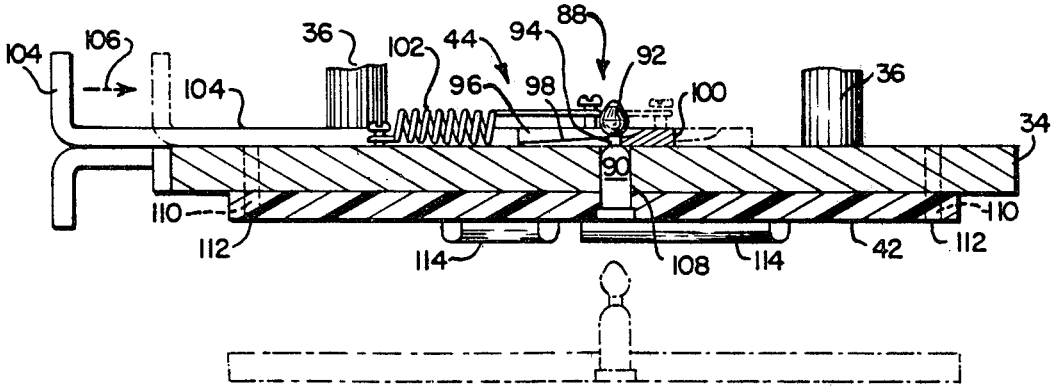
FIG. 3 is a section, on an enlarged scale, along the line 3—3 of the part shown in FIG. 2.

With particular reference to FIGS. 2 and 3, the die plate 42 is shown secured to the underside of the carrier plate 34 by the quick connect and disconnect mechanism 44. Due to the removability feature of both the die plate 42 and the workplate 40, the contour cementing machine 10 is quickly and easily convertible to widely differing sizes, shapes and styles of flat work pieces intended to be cemented thereby. The die plate 42 and the workplate 40 preferably are formed of a resin reinforced with glass fibers, such as sold under the trademark, FIBERGLAS, for strength and compatibility with the latex cement. The die plate 42 is provided with a pair of bullet-shaped fasteners 88. These fasteners 88, preferably formed of chrome-hardened steel for compatibility with the latex cement, have a body portion 90, a head portion 92 and a connecting neck portion 94, as may be best observed in FIG. 3. The head and neck portions 92 and 94 are designed to cooperate with approximately formed flared slots 96, each having an inclined channel 98, and provided in a cross plate 100 of the quick connect and disconnect mechanism 44. The cross plate 100 is slidably secured on top of the carrier plate 34, and is urged toward the front, i.e., the fastener 88 engaging direction, by a pair of tension springs 102. A manually movable member 104 is secured centrally to the cross plate 100. Member 104 is designed to move the cross plate 100 toward the rear, and against the force of the springs 102, in the direction of the arrow 106, i.e., into the fastener 88 disengaging direction. When the neck portion 94 of the fastener 88 is free of the inclined channel 98 of the slot 96, the fasteners 88 slide through their respective holes 108 formed in the carrier plate 34, disconnecting the die plate 42 from the underside of the carrier plate 34. For purposes of precise orientation, the die plate 42 preferably also is provided with holes 110 in its respective carriers. These holes 110 are designed to accommodate therein an equal number of locating pins 112 provided in and downwardly projecting from the carrier plate 34. Connection of the die plate 42 to the carrier plate 34 requires only that the locating pins 112 fix the precise orientation of the die plate 42 with respect to the carrier plate 34 by engaging the holes 110 of the die plate 42. Whereupon, gentle but sustained upward pressure on the die plate 42 toward the carrier plate 34 pushes the fasteners 88 through their respective holes 108 in the carrier plate 34 until the head portions 92 engage the flared slots 96. Due to the particular shape of these head portions 92, further upward motion of the fasteners 88 effects a progressively gradual displacement of the cross plate 100 rearwardly and against the force of the springs 102 until the head portions clear the flared slots. Thereupon, the neck portions 94 become engaged by the slots 96 and the force of the tension springs returns the cross plate 100 into its original, fastener-engaging position. The inclined channels 98 serve to ensure that, in the fastener-engaging position, the die plate 42 lies, with a wear factor built in, against the underside of the carrier plate 34 and is so held thereagainst, as may be best observed in FIG. 3.

Figure 5:
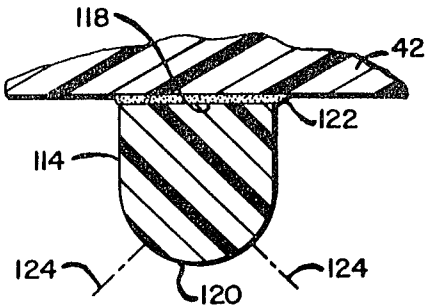
FIG. 5 is a section, on a greatly enlarged scale, along the line 5—5 of a portion of the component shown in FIG. 4.
Figure 4:
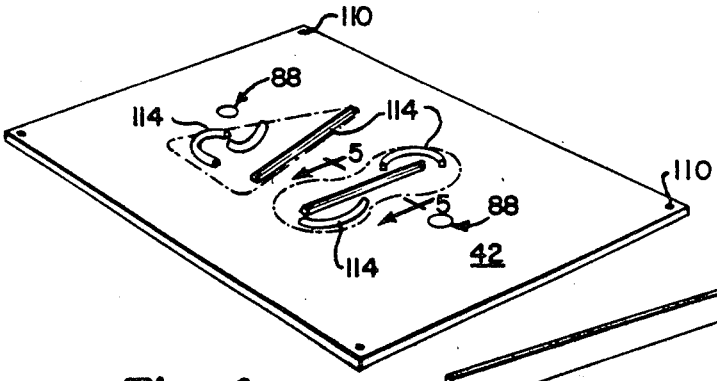
FIG. 4 is a perspective view of a component of the part shown in FIG. 2.
Figure 6:
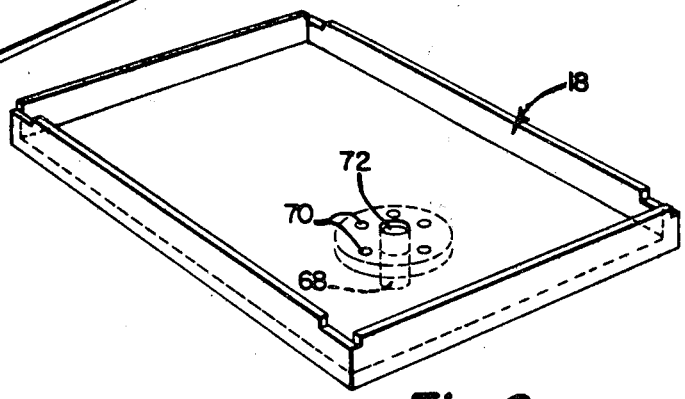
FIG. 6 is a perspective view of a different part of the contour cementing machine of FIG. 1.

The die plate 42 carries on its underside a plurality of die members 114, please note in particular FIG. 4. It is these die members 114 that pick up and deposit the latex cement onto work pieces 116 located on the workplate 40. These die members 114 are deformable, resilient strips, preferably formed of urethane, or like material, with a Shore-A hardness of between about 35 to about 40 durometers. A greatly enlarged section of such a resilient strip 114 is shown in FIG. 5. As shown, the strip or die member 114, in cross section, defines a flat bottom surface 118 and a top round surface 120. The die members 114, after being cut to length, removably are secured to the die plate 42 by a layer 122 of adhesive. The dashed lines 124 indicate the preferred area therebetween of the top round surface 120 of the die member 114 that is dipped into the latex cement found within the tray 18.

A piston 126 of a two-stage double acting piston-cylinder 128 is attached, preferably centrally, to the actuating plate 32. When a top cover 130 is removed from the piston-cylinder 128, an internally-threaded member 132 is exposed, designed to be axially displaceable about an externally-threaded portion 134 of the piston-cylinder 128. By adjusting the axial position of the member 132 about the portion 134, the extent of the axial travel of the piston 126 can be carried, whereby the extent of the downward pressure exerted by the die members 114 against the work piece 116 is regulated.

The contour cementing machine 10 is, furthermore, provided with a plurality of limit valves and positive stops, not shown, so as to provide the machine 10 with built-in safety features for the added protection of the operator. Further, a timer and additional air logic equipment preferably are mounted within a suitable box 136. Also preferably, two manually actuatable switches 138 and 140 are provided, both of which need be depressed before the contour cementing machine 10 will commence operating. Alternatively, the switches 138, 140 may be rendered operational by the closing of appropriate access doors, not shown, and the machine 10 designed to commence operating by depressing a foot pedal, not shown.

The work pieces 116 preferably are positioned on top of resilient, contoured pads 142, which conveniently and removably are secured, as by double-faced adhesive tape, to the workplate 40. The workplate 40 is, as mentioned, removably secured to the slide tray 41 via the two pins 43. These resilient pads 142, preferably formed of spongy open cell foam neoprene rubber, serve a triple function: first, the contoured pads 142 help precisely to locate the work pieces 116 on the workplate 40; second, the contoured pads 142 help to cushion the impact of the downward pressure of the die members 114 when they contact the work pieces 116; and thirdly, aid in precise cement application. The work pieces 116 themselves also are preferably releasably secured to the pads 142 by double-faced adhesive tapes 144 positioned on the pads 142. Absent these adhesive tapes 144, the work pieces 116 might be lifted or otherwise displaced by the die members 114 during the cement applying step. In the alternative, the work pieces 116 also can be held in place on the workplate 40 by vacuum, as known. Preferably, the edges of the pads 142 are trimmed to prevent cement contamination. Also preferably, to facilitate the cleaning of the die members 114 carried by the die plate 42, a suitable release coat may be applied on the die members 114. The release coat of course must be compatible with the latex cement. Further, all parts of the contour cementing machine 10 that are likely to come into direct contact with the latex cement are to be formed of a material that is compatible therewith. For instance, the die plate 42, the workplate 40 and the slide tray 41 preferably are formed of fiberglas, the tray 18 of polyethylene and the base plate 26 of a suitable paper laminate with an expoxy cement. As known, latex cement interacts adversely with aluminum and brass, so these materials should be avoided. Since steel has a tendency to rust when exposed to latex cement, if used, steel is to be chrome plated for protection.

The operation of the contour cementing machine 10 best is described with reference to FIGS. 7–10. With latex cement at a predetermined level 146 in the tray 18, the operator applies the work piece 116 onto the contoured resilient pad 142. The die plate 42 is now in its inoperative position. Then, with both hands, the operator actuates the machine 10 by depressing switches 138 and 140. The following operative steps then proceed automatically. First, the die plate 42 is vertically displaced from its inoperative position, shown in FIG. 7, to its cement pick-up position illustrated in FIG. 8. This vertical displacement of the die plate 42 is effected by the two-stage double acting piston-cylinder 128 via the actuating plate 32. In this cement pick-up position, the carrier plate 34 is resting flush on top of the cement tray 18. Should the operator wish to take a break for lunch, he/she would arrest the operation of the machine 10 at this point. This can be effected in several ways, one of which includes the actuation of a stop button 148. With the air supply remaining on, the cement tray 18 is completely covered by the carrier plate 34 in the cement pick-up position and the cement in the tray 18 is somewhat protected against deterioration. Without this complete enclosure of the cement within the tray 18, the latex cement would have to be drained from the tray 18. For, otherwise, the latex cement would harden in the tray 18, requiring an arduous and time-consuming clean-up operation.

Figure 8:
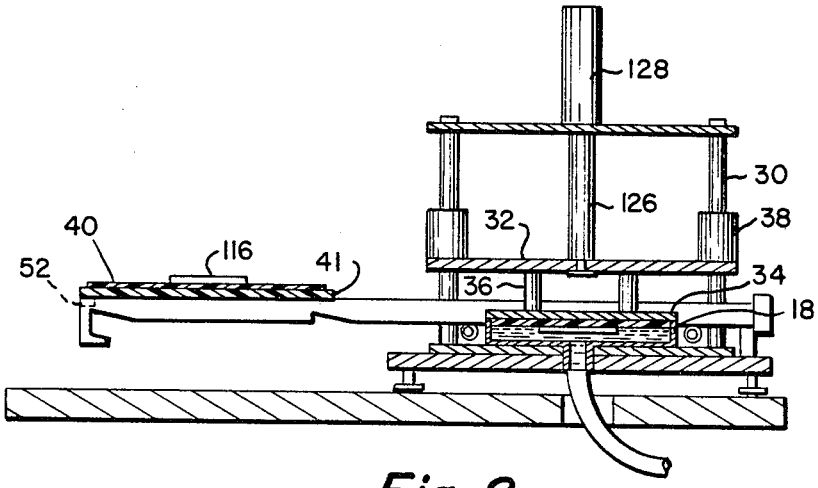
Figure 9:
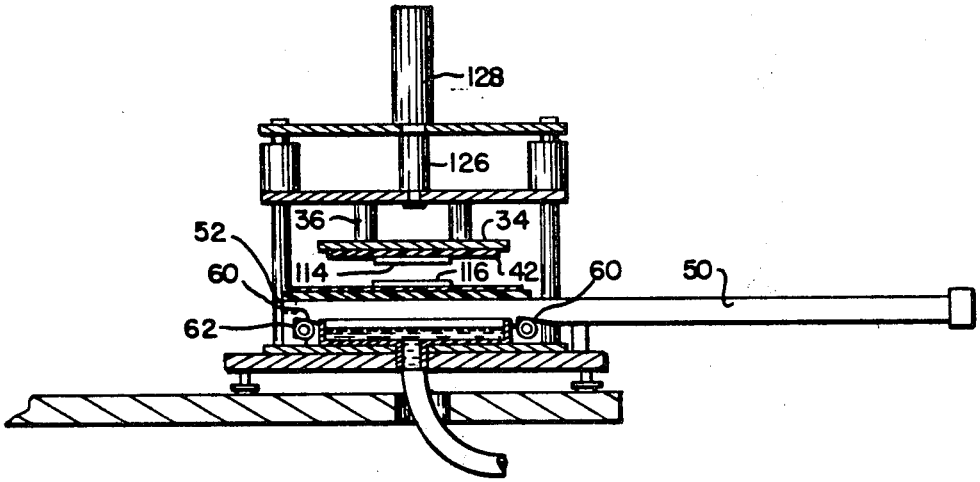

In this cement pick-up position shown in FIG. 8, only the die members 114, more precisely, only the top round surface 120 (note FIG. 5) of the die members 114 enter below the predetermined level 146 and into the latex cement. After a suitable dwell time to assure the pick-up of the required amount of cement, the die plate 42 is raised to its original position and the workplate 40 is caused horizontally to be moved, via the pair of supporting members 50, into position below the die plate 42, observe FIG. 9. This horizontal movement of the workplate 40 is effected by the double-acting piston-cylinder 46, shown in and described with reference to FIG. 1. To facilitate this horizontal motion, the members 50, with their undersides 58, first ride on the pair of rollers 56 until the rollers enter the pair of inclined indents 60. The workplate 40, riding on top of the slide tray 41, comes to rest on top of the pair of channels 54 when the pair of stops 52 abut against the ends of the channels 54, with the end hooks 62 securely locked about the front rollers 56. Thus, it is not the pair of rollers 56 that have to bear the downward pressure exerted by the die plate 42 on the workplate 40 during the cementing operation next following.

Figure 10:
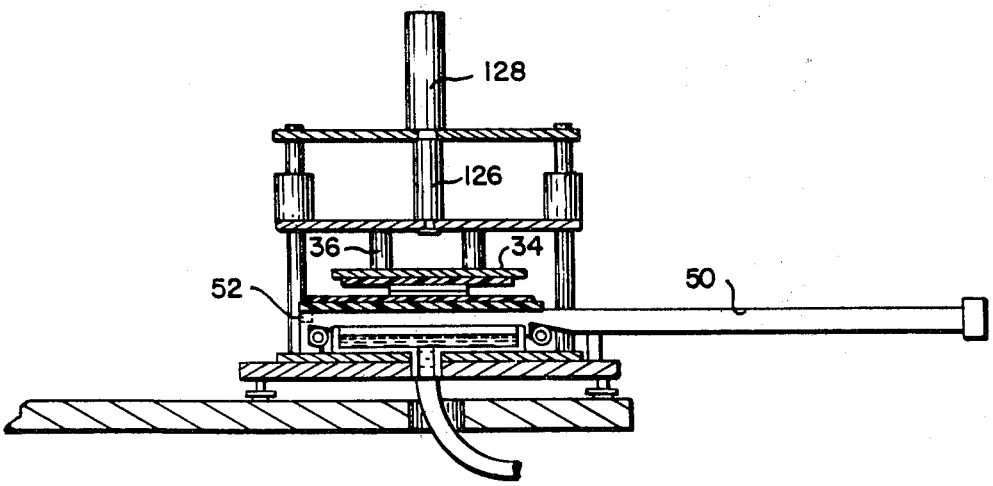

The cement applying operation is illustrated in FIG. 10. A comparison of FIG. 10 with FIG. 8 readily reveals that the die plate 42 in the cement applying position does not travel downward as much as it does in the cement pick-up position. That is the reason for the piston-cylinder combination 128 to be not only double-acting but being also two-stage: i.e., effecting both a longer and shorter downward displacement by its piston 126. It is in the cement applying position of the die plate 42 that the thereon carried die members 114 contact the work pieces 116. More precisely, it is the top round surfaces 120 of the die members 114, carrying a coat of latex cement, that are pressed into contact with the workpieces 116. Depending upon the selected contacting pressure and of course upon the width of the die members 114, the width of the layer of latex cement being applied to the work pieces 116 can be precisely controlled. The contacting pressure of the die members 114 with the work pieces 116 is adjustable by adjusting, over a length of about one inch, the axial position of the member 132 about the externally-threaded portion 134 located on top of the cylinder 128. Consequently, with the same die member 114, the width of the layer of latex cement being applied to the work piece may be varied, as for example by as much as an eighth of an inch.

Figure 7:
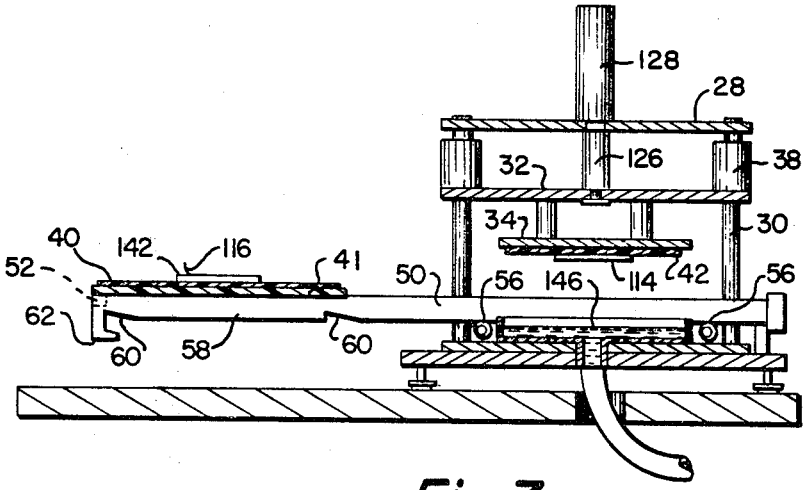
FIGS. 7–10 are schematic side elevations, partly in section, of the contour cementing machine of the inventions, illustrating certain principles of its operation.

Following an appropriate dwell-time in the cement applying position as just described with reference to FIG. 10, the die plate 42 is raised to its original inoperative position shown in FIG. 7. Thereupon, the workplate 40 is moved horizontally back to its original position, and the die plate 42 returns to its cement pickup position shown in FIG. 8. With one cementing cycle now completed, the contour cementing machine 10 stops automatically and will not re-cycle until the operator once again depresses the two actuating switches 138 and 140, or the foot pedal, not shown.

Thus it has been shown and described a contour cementing machine 10, which machine 10 satisfies the objects and advantages set forth above.

Since certain changes may be made in the present disclosure without departing from the scope of the present invention, it is intended that all matter described in the foregoing specification or shown in the accompanying drawings, be interpreted in an illustrative and not in a limiting sense.

What is claimed is:

1. A contour cementing machine comprising:

(a) a housing;

(b) a cover for said housing;

(c) a die structure mounted in said housing, said die structure including a horizontally movable workplate and a vertically movable die plate;

(d) a tray removably disposed in said housing in operative association with said die structure, (e) means for maintaining a predetermined level of cement in said tray;

(f) said machine being pneumatically actuated and designed for applying latex cement in complex shapes to flat workpieces deposited on said horizontally movable workplate;

(g) said workplate designed for movement between a work-applying position and a cementing position and said die plate designed for vertical displacement between two operative positions: a cement pick up position, and a cement applying position; and (h) rolling means to facilitate the movement of said workplate from its said work-applying position to its said cementing position, said rolling means not supporting said workplate in its said cementing position.

2. A machine for applying latex cement in complex shapes to flat work pieces, comprising:

(a) a housing having a cover;

(b) a die structure mounted in said housing, said die structure including a workplate supporting said flat work pieces and designed to move in and out of said housing and a die plate carrying a plurality of die members, said workplate being removably secured to a slide tray of said die structure;

(c) a tray mounted in said housing in association with said die structure;

(d) means for maintaining a predetermined level of cement in said tray; and (e) means for moving said die plate first into contact with said tray and second into contact with said workplate;

(f) said means for moving said die plate being a two stage double-acting piston-cylinder.

3. The machine of claim 2 further including means for moving said workplate in and out of said housing and wherein said means and said means for moving said die plate are pneumatically actuated.

4. The machine of claim 2 further including means operatively disposed about said two-stage double-acting piston-cylinder to vary the force of contact of said die plate with said workplate.

5. A machine for applying latex cement in complex shapes to flat work pieces, comprising:

(a) a housing having a cover;

(b) a die structure mounted in said housing, said die structure including a workplate supporting said flat work pieces and designed to move in and out of said housing and a die plate carrying a plurality of die members;

(c) a tray mounted in said housing in association with said die structure;

(d) means for maintaining a predetermined level of cement in said tray; and (e) means for moving said die plate first into contact with said tray and second into contact with said workplate;

(f) said housing comprising a base plate and a top plate, a plurality of posts securing said top plate in spaced apart relation to said base plate, an actuating plate carried by said plurality of posts for vertical displacement between said base plate and said top plate, and a carrier plate secured to said actuating plate, said carrier plate removably carrying said die plate.

6. The machine of claim 5 further including a plurality of self-aligning bearing blocks securing said actuating plate to said plurality of posts.

* * * * *